US006106201A

United States Patent [19]

Bourdouxhe

[11] Patent Number: 6,106,201

[45] Date of Patent: Aug. 22, 2000

[54] Z-SHAPED SHEET PILE WITH HIGH SECTION MODULUS

[75] Inventor: Michel Bourdouxhe, Luxembourg, Luxembourg

[73] Assignee: Profilarbed S.A., Esch-sur-Alzette, Luxembourg

[21] Appl. No.: 09/176,342

[22] Filed: Oct. 21, 1998

Related U.S. Application Data

[63] Continuation of application No. PCT/EP97/00125, Jan. 13, 1997, abandoned.

[51] Int. Cl.[7] ..... E02D 5/08

[52] U.S. Cl. ..... 405/281; 405/276

[58] Field of Search ..... 405/278, 279, 405/280, 281, 274

[56] References Cited

U.S. PATENT DOCUMENTS

| | | | |
|---|---|---|---|
| 1,012,124 | 12/1911 | Conkling | 405/278 |
| 1,831,427 | 11/1931 | Schroeder . | |
| 1,834,744 | 12/1931 | Schroeder | 405/278 |
| 1,841,759 | 1/1932 | Nolte | 405/281 |
| 2,056,066 | 9/1936 | Greulich | 405/218 |
| 2,104,116 | 1/1938 | Borberg | 405/281 |
| 2,128,740 | 8/1938 | Dougherty | 405/218 |

FOREIGN PATENT DOCUMENTS

| | | | |
|---|---|---|---|
| 641754 | 4/1928 | France | 405/281 |
| 686816 | 7/1930 | France . | |
| 516106 | of 0000 | United Kingdom . | |

OTHER PUBLICATIONS

Lieferprogramm Profile—Warmgewalzte Profile, "Spundwandhandbuch Profiltafeln", Hoesch Stahl AG, 1990, p. 1. Profildarstellungen, Profilnormen, "Spundwandhandbuch Profiltafeln", Hoesch Stahl AG, Jan. 1992, pp. 29–36.

*Primary Examiner*—Dennis L. Taylor
*Attorney, Agent, or Firm*—Chapman & Cutler

[57] ABSTRACT

A hot-rolled Z-shaped sheet pile comprises two flanges (12', 12") and a web (10) delimited by two substantially plane faces (18', 18"). This web (10) makes an acute angle 75o with a plane (16) parallel to the outer faces (14', 14") of the flanges (12', 12"). In order to increase the section modulus of this sheet pile without having to increase the thickness of the flanges (12', 12") or the rolling width, each of the two flanges (12', 12") has an extension (22', 22") protruding with respect to the fictitious plane (24', 24") extending the plane face (18', 18") of the web located on the same side as the outer face (14', 14") of the respective flange. In this way, it is possible to roll sheet piles having a section modulus per unit length of the wall 4800 cm3/cm and a specific section modulus of approximately 20 (cm3/m)/(kg/m2).

16 Claims, 2 Drawing Sheets

Z-SHAPED SHEET PILE WITH HIGH SECTION MODULUS

This is a continuation of International Application PCT/EP97/00125, with an international filing date of Jan. 13, 1997, now abandoned.

BACKGROUND OF THE INVENTION

1. Field of Invention

The present invention relates to metallic sheet piles included as intermediate sections in combined supporting walls intended to hold back the soil, and more particularly, to a Z-shaped sheet pile with a high section modulus.

2. Description of the Related Art

Z-shaped sheet piles have been known for a long time. They have an inclined web connected to two substantially parallel flanges. Each flange is fitted with a gripping element, in order to form a joint in a supporting wall by interlocking with a gripping element of an adjacent sheet pile. In such a wall, the Z-shaped sheet piles are most frequently arranged constructed so that their flanges are substantially parallel and equidistant from the neutral bending plane of the wall. The product obtained by multiplying the section modulus of the wall with respect to this neutral plane by the maximum admissible elastic stress determines the maximum elastic moment that the wall can withstand.

What is called the "section modulus per unit length" of the sheet-pile wall is the section modulus with respect to the neutral plane of the wall per running meter of the wall. What is called the "specific section modulus" or the "performance criterion" of the sheet-pile wall is the section modulus per unit length divided by the mass of the wall per square meter of wall. It is specified that a "sheet-pile wall" in the present context is understood to be a wall consisting of Z-shaped sheet piles which are connected so that their flanges are substantially parallel and equidistant from the neutral bending plane of the wall.

ProfilARBED S.A. (Luxembourg) currently market a Z-shaped sheet pile called "AZ36", which has a section modulus of 3600 cm3 per running meter of wall. This AZ36 sheet pile has a mass of 194 kg/m2 and hence a specific section modulus of 18.6 (cm3/m)/(kg/m2). This is a sheet pile with gripping elements of the LARSSEN type shown in FIG. 1 as elements 20', 20", which are well known in the field, and with a web making an acute angle of about 63° with a plane parallel to the flanges. ProfilARBED S.A. (Luxembourg) also market a Z-shaped sheet pile called "BZ42", which has a section modulus of 4200 cm3 per running meter of wall, but a mass of 271 kg/m2 and hence a less favorable specific section modulus of 15.5 (cm3/m)/(kg/m2). This is a sheet pile with gripping elements of the BELVAL type and with a web making an acute angle of about 83.5° with a plane parallel to the flanges. Other types of Z-shaped sheet piles also to be found on the market can have section modulus up to 4550 cm3 per running meter of wall. However, these types of sheet pile with a higher section modulus are very heavy sections, with a very great weight per square meter of wall and therefore quite a low specific section modulus. Now, the lower the specific section modulus the higher the cost price of the wall.

The main reasons why Z-shaped sheet piles with a section modulus greater than 4550 cm3 are not found on the market are as follows:

Most frequently, there is a limit to the maximum thickness of the flanges. This is because the rolling of the gripping elements, particularly the LARSSEN type gripping elements, requires the flanges to be folded during the last pass of the rolling mill. Now, this folding becomes very difficult when the thickness of the flanges becomes too large. Thus, there is no present industrial method of rolling flanges with a thickness greater than 20 mm when they have gripping elements of the LARSSEN type.

There is also a limit on the maximum width of the flanges and the maximum distance between the outer faces of the flanges (height of the section). This is because, for a given angle of inclination of the web, the width of the flanges and the height of the section determine the development of the sheet pile and consequently the width of the roll stand rollers. Now the width of these rollers is limited by the width of the roll stands of the sheet pile rolling train. If it is required to roll sheet piles with a high section modulus on current rolling trains, the development of these sheet piles between the axes of the gripping elements must be less than a value predetermined by the width of the roll stands of the sheet pile rolling train.

A saving in the rolling width could be achieved by increasing the acute angle that the web makes with a plane parallel to the flanges (angle of inclination of the web). However, the nearer this angle of inclination of the web is to 90° the greater the resistance experienced when driving in the sheet pile. For reasons related to the use of the sheet pile, it is therefore recommended that the angle of inclination of the web should be chosen to be less than 75°.

Using an optimization program and a computer, the above-mentioned parameters have been optimized for a type AZ sheet pile, and a sheet pile has been obtained with a maximum section modulus of 4400 cm3 per running meter of wall. This type AZ sheet pile has, for a web thickness of 15 mm, a mass of 229 kg/m2 and thus a specific section modulus of 19.21 (cm3/m)/(kg/m2). A section modulus of 4400 cm3 therefore seems to be a limiting value for a Z-shaped sheet pile when compliance with the above-mentioned constraints is required. It would of course be possible to increase the web thickness still further, but such a step, while slightly increasing the section modulus, would mainly cause an appreciable reduction in the specific section modulus of the sheet pile.

The problem on which the present invention is based is to find a solution in order to increase still further the section modulus of a hot-rolled Z-shaped sheet pile, without at the same time reducing the specific section modulus of the sheet pile and without requiring an increase in the width of the roll stands.

This problem finds a solution in a Z-shaped sheet pile according to the first claim.

As regards the present state of the art, it should also be noted that the protruding extensions at the points connecting the flanges and webs of the sheet piles have already been described in the documents U.S. Pat. No. 1,831,427 and FR-A-686816, but are so described in a context completely different from the present invention. In fact, neither of these two documents relates to hot rolling or to the increase in the section modulus of a Z-shaped sheet pile. The document U.S. Pat. No. 1,831,427 describes special Z-shaped sheet piles which make it possible to produce, in cooperation with intermediate flat sheets, a sheet-pile wall with a continuous plane surface. The special sheet piles described in this document are more than likely sheet piles made of cast iron. Their web makes an angle close to 90° with a plane parallel to the outer faces of the flanges. At the joins between the web and the flanges, they have ribs, ridges, shoulders or projections incorporated in the sheet pile or attached by any means whatsoever to it. The only purpose of these ribs, ridges, shoulders or projections is to become engaged in recesses of complementary shape made in the said intermediate sheets. In this way, they make it possible to insert and hold in place these intermediate sheets between two Z-shaped sheet piles, in order to create the sheet-pile wall with a continuous plane surface. U-shaped sheet piles of small height are known from the document FR-A-686816, such sheet piles having a reinforced part at the position of the connections between the web and the flanges. In an assembly consisting of two of these sheet piles, the said reinforced part, located immediately before the opening in a clutch in the first sheet pile, acts in combination with the inner part of this clutch to create a shape capable of cooperating with the outer part of a clutch on the second sheet pile.

The hot-rolled Z-shaped sheet pile according to the invention comprises, like all hot- rolled Z-shaped sheet piles, two flanges having substantially parallel outer faces, and an oblique web connected to the two flanges. This web makes an acute angle less than or equal to 75° with a plane parallel to the outer faces of the flanges and is delimited between the connections to the flanges by two substantially plane faces. The hot-rolled sheet pile according to the invention is distinguished from a conventional hot-rolled sheet pile mainly in that each of the two flanges has an extension which protrudes with respect to a fictional plane extending the plane face of the web located on the same side as the outer face of the respective flange.

It is to be appreciated that a hot-rolled sheet pile according to the invention has the advantage of being produced with a small surplus of material, and therefore with a small increase in the mass per square meter of wall, a distinct improvement in the section modulus and consequently also an improvement in the specific section modulus. It is to be particularly appreciated that this improvement in the section modulus may be obtained without increasing the width of the roll stands, without increasing the thickness of the flanges, and that it even makes it possible to increase the useful width of the flanges. The proposed solution also leads to a strengthening of the corners of the flange/web connection on the outer side, and hence a lower risk of these critical places being damaged when the sheet piles are used. This strengthening is also favorable to a better resistance to accelerated corrosion at low water levels since Z-shaped sheet piles, unlike U-shaped sheet piles, have above all a tendency to become corroded at the web/flange connections. It remains to point out that the flanges have greater supporting surfaces (=outer faces of the flanges) for walling or anchoring plates, and that the transmission of the anchoring forces from the flanges to the web and vice versa is improved.

It is to be particularly appreciated that it has been possible to obtain sheet piles according to the invention with the following characteristics:

| | |
|---|---|
| thickness of flanges | approximately 19 to 20 mm; |
| width of flanges | 200 mm; |
| height of sheet pile | 500 mm; |
| section modulus per unit length of wall | 4800 cm3/m; |
| specific section modulus | approximately 20 (cm3/m)/(kg/m2). |

BRIEF DESCRIPTION OF THE DRAWINGS

A preferred embodiment of a sheet pile according to the invention is described with the help of the appended drawings, in which.

DESCRIPTION OF THE PREFERRED EMBODIMENTS

Figure 1:
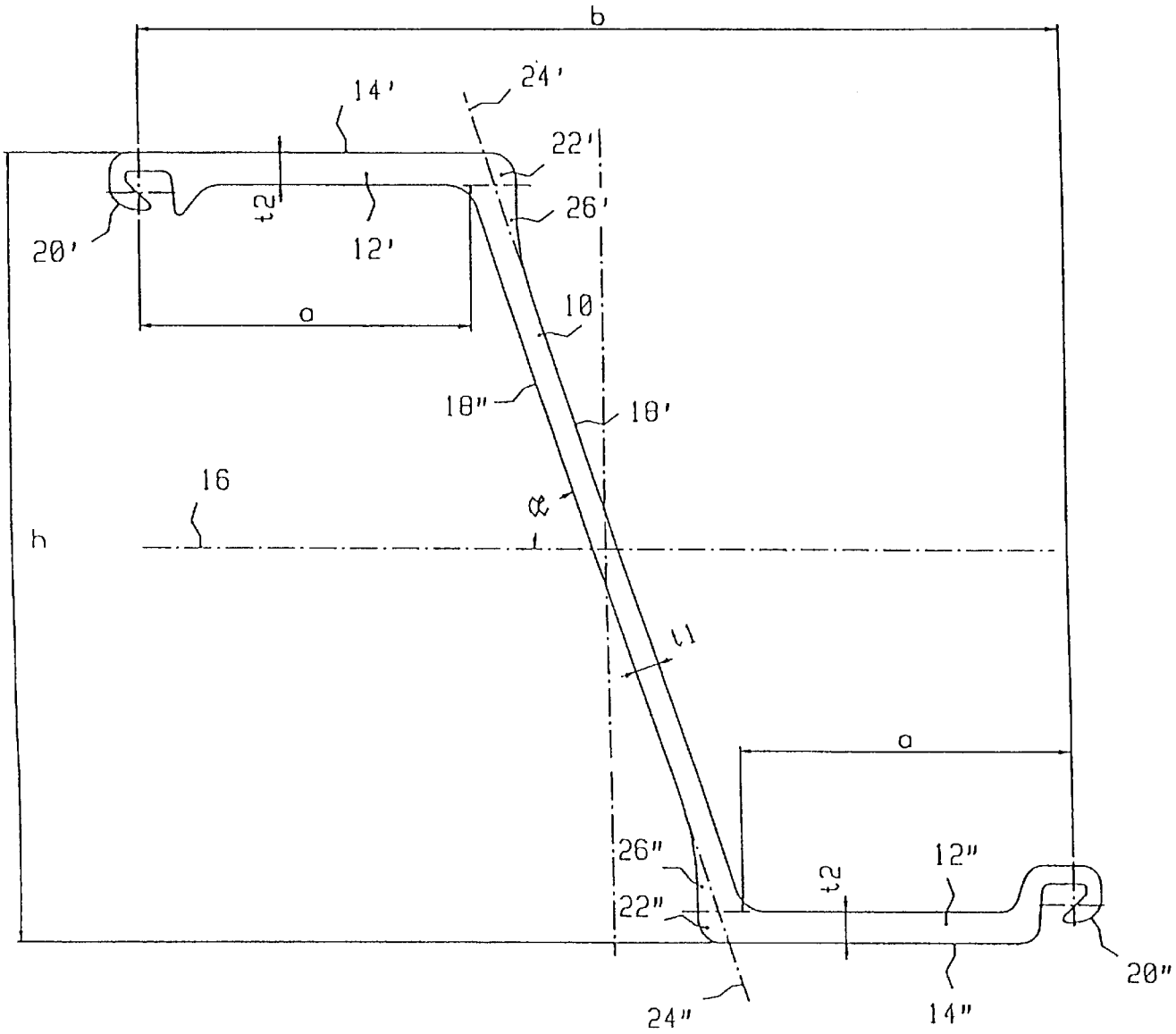
FIG. 1 shows a transverse cross-section of the sheet pile.

The Z-shaped sheet pile according to FIG. 1 comprises, like all Z-shaped sheet piles, two flanges 12', 12" having substantially parallel outer faces 14', 14", and an oblique web 10 connected to the two flanges 12', 12". This web 10 makes an acute angle with a plane 16 which is parallel to the outer faces 14', 14" of the flanges 12', 12". It is thinner than the flanges 12', 12" and is delimited between the connections to the flanges 12', 12" by two substantially plane and parallel faces 18', 18".

Each of these flanges 12', 12" is fitted with a gripping element 20", 20". More precisely, these are gripping elements of the LARSSEN type, which make it possible to form LARSSEN type joints by becoming interlocked, in a sheet-pile wall, with the gripping elements of adjacent sheet piles.

The dimensions of the sheet pile represented have been optimized using an optimization program and a computer in order to obtain a high section modulus given the various constraints mentioned in the introductory part of the present description.

This optimization has led to the following dimensions being adopted:

| | |
|---|---|
| height of the sheet pile section (distance between the outer faces of the flanges): | h = 482 mm |
| width of each flange 12', 12": | a = 208 mm |
| thickness of the web 10: | t1 = 15 mm |
| thickness of each flange 12', 12": | t2 = 19 mm |
| angle of inclination of the web 10: | a = 71° |

Thanks to the optimization of the above-mentioned dimensions, a section modulus was obtained of 4400 cm3 per unit length of a wall in which these sheet piles are connected so that the outer faces 14', 14" of their flanges 12', 12" are substantially parallel and equidistant from the neutral bending plane of the wall. The specific section modulus of such a sheet-pile wall is slightly less than 20 (cm3/m)/(kg/m2).

The aim was now to increase still further the section modulus of the sheet pile thus optimized.

This aim was achieved by fitting each of the two flanges 12', 12"with an extension 22', 22"which protrudes with respect to a fictitious plane 24', 24"extending the plane face of the web 18', 18"located on the same side as the outer face 14', 14"of the respective flange. A broken line in FIG. 2 has showed a connecting surface 25 which would terminate the flange 12' in a conventional Z-shaped sheet pile. This connecting surface 25 would be tangential to the outer face 14' of the flange 12' and would be connected tangentially to the face 18' of the web 10.

Figure 2:
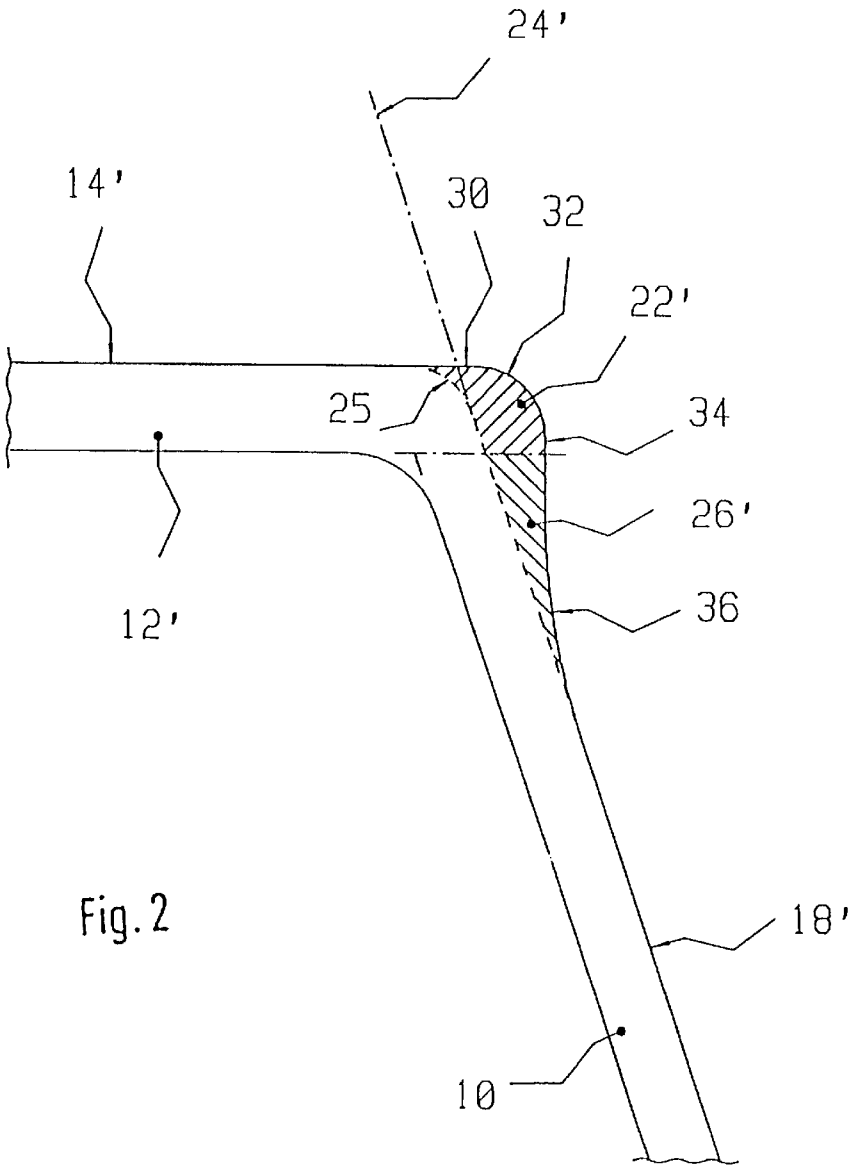
FIG. 2 shows an enlargement of a flange/web connection of the sheet pile of FIG. 1.

Referring to FIG. 2, it will be noted that the web 10 is connected to the flange extension 22' by a local extra thickness 26' of the web 10 so as to avoid the formation of a concave comer between the flange extension 22' and the web 10. This extra thickness 26' of the web 10 slightly reduces the specific section modulus of the sheet pile, but it makes rolling easier and avoids deformations of the flange extension 22' during pile driving. In addition, a better transmission is obtained of the anchoring forces from the flanges 12', 12"to the web 10 and vice versa.

It can also be seen in FIG. 2 that the flange extension 22' is delimited by a first plane surface 30 which extends the plane face 14' of the flange 12', a second plane surface 34 which is substantially perpendicular to the said first plane surface 30, and a convex cylindrical connecting surface 32 which connects the said first plane surface 30 to the said second plane surface 34. The said extra thickness 26' of the web 10 then defines a concave cylindrical connecting surface 36 which connects the face 18' of the web 10 to the said second plane surface 34 of the flange extension 22'. This is a configuration of the flange extensions 22' and 22"which is optimized from the point of view of rolling.

In the example of FIG. 1, the convex cylindrical connecting surface 32 has a radius of 15 mm, and the concave cylindrical connecting surface 36 has a radius of 125 mm. The section modulus per unit length of the optimized sheet pile with flange extensions 22', 22" is 4800 cm3/m, which represents an increase of about 9% compared with the optimized sheet pile without the flange extensions 22', 22". The specific section modulus of the optimized sheet pile with flange extensions 22', 22" is about 20 (cm3/m)/(kg/m2).

It is to be appreciated that the rolling of the flange extensions 22', 22" causes no major problems and in particular requires no increase in the width of the roll stands of the rolling train, which makes the invention particularly attractive for sheet piles of large section.

It remains to point out that the invention is, of course, not limited to the sheet pile described in detail, but that it can also be advantageously applied to Z-shaped sheet piles having a section modulus per unit length smaller or greater than 4800 cm3/cm of substantially different dimensions, and to sheet piles having gripping elements other than LARSSEN type gripping elements.

What is claimed is:

1. A hot-rolled Z-shaped sheet pile with a high section modulus, comprising:

two flanges having substantially parallel outer faces; and an oblique web connected to said two flanges so as to make an acute angle $\alpha \leqq 75°$ with a plane parallel to the outer faces of the flanges, said web being delimited by two substantially plain faces, wherein each of said two flanges has an extension which protrudes with respect to a fictitious plane extending the plain face of the web located on the same side as the outer face of the respective flange.

2. The sheet pile according to claim 1, characterized by the following parameters:

section modulus per wall length unit is at least 4800 cm3/m;

specific section modulus is about 20 (cm3/m)/(kg/m2).

3. The sheet pile according to claim 2, further characterized by the following parameters:

thickness of the flange s is provided in a range from 19 to 20 mm;

width of flanges is at least 200 mm;

height of the sheet pile is no more then 500 mm.

4. The sheet pile according to claim 3, wherein each of the flanges is provided with a gripping element.

5. The sheet pile according to claim 4, wherein said gripping elements are LARSSEN type gripping elements.

6. The sheet pile according to claim 1, wherein the web is connected to each flange extension through an intermediary of an extra thickness of the web so as to avoid a concave corner between the web and respective flange extension.

7. The sheet pile according to claim 6, wherein said flange extension is delimited by a first plane surface extending the outer face of the respective flange, a second plane surface, which is substantially perpendicular to said first plane surface, and a convex cylindrical connecting surface which connects said first plane surface to said second plane surface.

8. The sheet pile according to claim 7, wherein said second plane surface of the flange extension is connected to the respective web face by a concave cylindrical connecting surface.

9. The sheet pile according to claim 8, wherein the acute angle between the web and the plane parallel to the outer faces of the flanges is substantially equal to $\alpha=71°$.

10. The sheet pile according to claim 9, wherein each of the flanges is provided with a gripping element.

11. The sheet pile according to claim 10, wherein said gripping elements are LARSSEN type gripping elements.

12. The sheet pile according to claim 8, characterized by the following parameters:

section modulus per wall length unit is at least 4800 cm3/m;

specific section modulus is about 20 (cm3/m)/(kg/m2).

13. The sheet pile according to claim 12, further characterized by the following parameters:

thickness of the flanges is approximately 19 to 20 mm;

width of flanges is at least 200 mm;

height of the sheet pile is no more then 500 mm.

14. The sheet pile according to claim 13, wherein the acute angle between the web and the plane parallel to the outer faces of the flanges is substantially equal to $\alpha=71°$.

15. The sheet pile according to claim 14, wherein each of the flanges is provided with a gripping element.

16. The sheet pile according to claim 15, wherein said gripping elements are LARSSEN type gripping elements.

* * * * *